United States Patent [19]

Even et al.

[11] 4,452,850

[45] Jun. 5, 1984

[54] ROOFING WEB COATED WITH PLASTICIZED POLYVINYL CHLORIDE ON BOTH SIDES

[76] Inventors: Gert Even, Höhenstrasse 45; Josef Kern, Friedensberger Strasse 17; Ernest de Ruiter, Höhenstrasse 57a, all of 5090 Leverkusen 3, Fed. Rep. of Germany

[21] Appl. No.: 292,859

[22] Filed: Aug. 14, 1981

Related U.S. Application Data

[63] Continuation of Ser. No. 146,828, May 5, 1980, abandoned.

[30] Foreign Application Priority Data

May 5, 1979 [DE] Fed. Rep. of Germany ..... 2918165

[51] Int. Cl.[3] ..... B32B 7/00

[52] U.S. Cl. ..... 428/252; 428/265; 428/267

[58] Field of Search ..... 428/236, 252, 265, 141, 428/142, 143, 144, 288, 267; 427/38.9

[56] References Cited

U.S. PATENT DOCUMENTS

| | | | |
|---|---|---|---|
| 2,598,090 | 5/1952 | Yung et al. | 428/252 |
| 2,606,845 | 8/1952 | Van Etten | 427/389.9 |
| 2,717,217 | 9/1955 | Sullivan | 427/389.9 |
| 3,554,852 | 1/1971 | Sugarman et al. | 428/236 |
| 3,650,879 | 3/1972 | Munting | 428/265 |
| 4,049,870 | 9/1977 | Brodmann | 427/389.9 |
| 4,064,306 | 12/1977 | Scotchner et al. | 428/288 |
| 4,109,543 | 8/1978 | Foti | 428/252 |
| 4,125,663 | 11/1978 | Eckardt | 428/288 |
| 4,140,829 | 2/1979 | Pemrick et al. | 428/265 |
| 4,160,058 | 7/1979 | K-Gall | 428/265 |

FOREIGN PATENT DOCUMENTS 564213 10/1958 Canada .

*Primary Examiner*—Marion F. McCamish
*Attorney, Agent, or Firm*—Sprung, Horn, Kramer & Woods

[57] ABSTRACT

A roofing web copmrising a fabric coated on both surfaces with plasticized polyvinyl chloride compositions containing different immiscible plasticizers.

16 Claims, No Drawings

ROOFING WEB COATED WITH PLASTICIZED POLYVINYL CHLORIDE ON BOTH SIDES

This is a continuation of application Ser. No. 146,828, filed May 5, 1980 now abandoned.

Roofing sheets or webs made of plastic materials are known. Conventionally they consist of about 1 mm. thick film of polyvinyl chloride (PVC). The film may also have embedded therein for reinforcement a 3×3 or 6×6 grenadine or cheese cloth or such a grenadine is sandwiched between two thinner PVC films. The PVC roofing webs have the advantage that they can be prefabricated and, therefore, are inexpensive and simple to lay and have a higher water vapor permeability than webs of bitumen or synthetic rubber. Disadvantages have been found to be their injurability by pointed objects such as roof nails having been left on the roof from an oversight or through negligence or pointed stones of the gravelling. If PVC roofing film becomes hard or brittle during the course of time and shrinks, this is primarily due to plasticizer losses by evaporation, migration or decomposition. If a conventional PVC roofing web is laid on a bitumen roof without an intermediate layer, part of the plasticizer will migrate into the bitumen as time passes.

It is an object of the invention to provide a roofing web which does not exhibit the disadvantages mentioned above and is distinguished above all by high mechanical stability, is substantially insensitive to perforation caused by negligence or othe damage in building operation and is resistant to any elongation or any shrinkage so that destructive stresses or, on inclined roofs, elongations caused by its own weight cannot occur even after many years. The mechanical stability should be sufficiently high that spot fixing becomes the normal case and the usual gravelling can be dispensed with. The roofing web should be able to be manufactured in extremely large widths and have sufficient tear resistance that it can even be fixed by nailing without problems. The permeability for water vapor should be sufficiently high that the roofing web can be laid unhesitatingly on a roof which is soaked with water or in moist weather, e.g. when repairing old roofs. For the repair of old roofs, the underside of the roofing web should be resistant to bitumen in order that the web can be laid directly on a bitumen roof having become leaky and previous removal of the old roofing is unnecessary. Moreover, care should be taken to ensure a long service life of the roofing web even under extreme conditions by a suitable chemical composition of both the fabric and the PVC coating so that, for example, the usual gravelling on flat roofs can be dispensed with. Finally, the roofing web should be difficult to ignite in the sense of the regulations of the building authorities, since even the repair of a readily inflamable roof results in substantially increased resistance to flying sparks and radiant heat alone or covering with such a sheeting.

In case of roofing sheets comprising a fabric which is coated with PVC on both sides, these objects are accomplished in accordance with the invention by the fact that the fabric is a full or dense fabric made of high tenacity synthetic individual fibers or continuous yarns and having a weight of 150 to 300 g./sq.m. and a tenacity of at least 200 daN/5 cm. Particularly useful are fabrics made of polyesters or aramides which are usual for textile purposes. The use of such a tightly woven or closed fabric of high tenacity fibers constitutes an almost indestructable and extremely dimensionally stable backbone of the roofing sheet according to the invention and minimizes the risk of perforations, elongation or shrinkage. The high mechanical stability permits spot fixing so that the usual gravelling can be dispensed with. This permits roof structures of lower weight and, therefore, but very substantial saving of cost. In contrast to roofing sheets which are bonded on the whole surface area, a roof cover with spot fixing conforms very well to the always occurring movements of the roof or structure. Due to the high tear resistance, a roofing web made of this tightly woven fabric may also be nailed without any problem. A further improvement of these properties can be achieved according to the invention by fixing the weft threads of the tightly woven polyester fabric with biasing in the PVC coating. The same applies to the warp threads extending in longitudinal direction of the web. This fixing with biasing is achieved by stretching the tightly woven polyester fabric in both longitudinal and transverse direction during the coating process.

The PVC coats on the top side and the underside of the roofing web according to the invention are preferably different and adapted to the particular requirements. If the underside should be resistant to bitumen according to a preferred embodiment of the invention, then the PVC coat contains on this side exclusively polymer plasticizers as plasticizers. These are commercially available. Above all, polyester plasticizers based on dicarboxylic acids having 4 to 10 carbon atoms and diols having 2 to 6 carbon atoms have been found to be useful. The polymer plasticizers are used in amounts of about 85 to 105 parts by weight per 100 parts by weight of PVC. The polymer plasticizers have the advantage that they do not migrate into bitumen when the web is laid on bitumen but remain in the PVC coat and, therefore, prevent the latter from becoming hard or brittle.

The plasticizers chosen for the top layer of the roofing web according to the invention are those which are not miscible with the polymer plasticizer of the bottom layer. The result hereof is that, in extended use of the roofing web, the plasticizer of the top layer also cannot migrate through the fabric and the bottom layer into the bitumen of an old roof covering. Examples of suitable plasticizers for the upper coating which are very stable and of low volatility and, therefore, do not evaporate and are not destroyed by atmospheric influences include phthalate plasticizers having 12 to 24 aliphatic carbon atoms in the alcohol moiety of the ester. When it is not essential in use of the roofing web that it is resistant to bitumen, oily wood preservatives or the like, the plasticizers which are usual for PVC, especially phthalate plasticizers, may also be used for the bottom coat.

Since the roofing webs according to the invention are manufactured by a plurality of coats applied in succession, it has been found to be particularly advantageous to utilize this manufacturing technique for preparing a web the lower and/or upper coatings of which consist of 6 to 10 individual layers having different compositions. Accordingly, the usual U.V. absorbers based, for example, on anthraquinone derivatives are predominantly incorporated in the external top layers of the top side in concentrations of 0.05 to 0.5% by weight of the coating. Similar considerations apply to pigments such as titanium dioxide which are used to take care that the top side is not only extremely light- and weather-resistant but also very bright. The result hereof is extensive reflection of incident solar heat and, consequently, a lower temperature of the roof covering. This is also favorable for the service life of the roof cover. Due to the construction of the roofing web according to the invention in a plurality of layers, it becomes possible to incorporate various fungicides such as arsenic, tin or mercury compounds in different layers in concentrations of 1 to 3% by weight of the coating. This has the result that smaller amounts of the fungicide are sufficient in the individual layer thereby increasing the compatibility of the fungicides with the PVC and the other necessary added materials such as stabilizers and additives. Fungi which have acquired some resistance to a specific fungicide after an extended period of time then meet in the next layer a fungicide to which they are not yet resistant. This increases still more the service life of the roofing web constructed in this manner.

The roofing webs according to the invention also contain the other stabilizers and additives which are usual for PVC roofing webs and which, for example, have the function that the roofing web is resistant to hydrolysis and that traces of acids are neutralized and made harmless by, for example, addition of active calcium carbonate. Flame proofing is achieved by means of additives which are usual for this purpose, e.g. by incorporation of antimony trioxide in amounts of 5 to 18% by weight, based on the coating.

Altogether, care is also taken that a water vapor permeability of 3 to 8 g./sq.m./24 hrs. is ensured. It is possible by this permeability that the roofing web according to the invention can be laid without hesitation on a roof which is soaked with water or in moist weather. Such a roofing web does not function in this case as a vapor barrier, but the moisture is diffused as vapor from the inside to the outside while water is incapable of penetrating the roofing web in the inverse direction.

It has also been found to be desirable to provide the bottom side and/or top side additionally with a surface lacquer. This top coat preferably consists of polyvinyl halides and has among other effects an efficient barrier effect against losses of plasticizer. Top lacquers which consist predominantly of polyacrylates have also been found to be advantageous.

The roofing webs according to the invention may be produced in extremely great widths of 205 to 320 cm. This facilitates laying and increases the safety and reliability because a lower number of welding seams is necessary. For use on inclined roofs, the top side of the roofing web may be embossed, e.g. in the form of truncated pyramids to render the web scuff-resistant and non-skid.

Altogether, the roofing web according to the invention meets the requirements explained above and, due to its high strength and the particular chemical structure, solves all problems in case of warm roofs, cold roofs, laying on wood, concrete, steel roofs, flat roofs, inclined roofs, direct laying on bitumen roofs requiring repair and shed roofs of all inclinations and structures. When repairing old roofs, the great advantage resides in the fact that the old roofing need not be removed and, in this case, moisture and cracks do not play a part. In case of flat roofs even on tall buildings, gravelling can be dispensed with.

EXAMPLE

Starting materials:

Fabric: Polyester fabric, 9/9, 1100 dtex

Paste for upper side and adhesion-promoting coat:

65 parts of phthalate plasticizer (28 and 32 carbon atoms) per 100 parts of PVC. The paste contained the usual stabilizers and pigments which are known to the skilled artisan as well as 5% by weight of $Sb_2O_3$ as flame retardant.

the adhesion-promoting coat (about 100 g./sq.m., contained additionally 5% by weight of an adhesion-promoting agent based on isocyanate and 1% by weight of a fungicide A.

The first top coat (about 300 g./sq.m.) contained additionally 1% by weight of a second fungicide B.

The second top coat (about 300 g./sq.m.) contained additionally 1% by weight of a third fungicide C and 0.25% by weight of an U.V. absorber based on anthraquinone.

Paste for the bottom side: 95 Parts of a polyester-based polymer plasticizer having 12 carbon atoms in the monomer unit per 100 parts of PVC.

The paste contained the usual stabilizers and pigments which are known to the skilled artisan as well as 5% by weight of $Sb_2O_3$ as flame retardant.

The first top coat (about 300 g./sq.m.) contained additionally 1% of the fungicide B and the second top coat (about 300 g./sq.m.) contained 1% of the fungicide C.

All of the PVC coats were gelled at 180° C. Finally, both sides were provides with a surface lacquer which chiefly contained acrylates.

The result was a product which is excellent when used for roofing.

What is claimed is:

1. A roofing web comprising a fabric which is coated with plasticized polyvinyl chloride material on both surfaces, the polyvinyl chloride being applied to each surface in multiple passes, the plasticizer of the coating applied to one surface differing from the plasticizer of the coating applied to the other surface, the two plasticizers being immiscible with each other, the fabric being a full tight weave of high tenacity polyester or aramide individual fibers or continuous yarns having a weight of 150 to 300 grams per square meter and a tenacity of at least 200 daN/5 cm.

2. A roofing web according to claim 1, characterized in that the weft threads of the tight weave are fixed with biasing in the polyvinyl chloride coating.

3. A roofing web according to claim 1, characterized in that the warp threads extending in longitudinal direction of the web are fixed with biasing in the polyvinyl chloride coating.

4. A roofing web according to claim 1, characterized in that the coating has a weight of 900 to 1600 grams per square meter.

5. A roofing web according to claim 1, characterized in that the coating has a weight of 1300 to 1500 grams per square meter.

6. A roofing web according to claim 1, characterized in that the coating on the bottom side contains exclusively polymer plasticizers as plasticizers.

7. A roofing web according to claim 1, characterized in that different fungicides are contained in the different layers.

8. A roofing web according to claim 1, characterized in that the U.V. absorbers are predominantly incorporated in the outer cover layers of the top layer.

9. A roofing web according to claim 1, characterized in that it has as a whole a water vapor permeability of 3 to 8 g./sq.m. 24 hrs.

10. A roofing web according to claim 1, characterized in that it is flame retardant.

11. A roofing web according to claim 1, characterized in that the bottom side and/or top side are provided with a surface lacquer coating.

12. A roofing web according to claim 11, characterized in that said surface lacquer is polyvinylidene halide.

13. A roofing web according to claim 11, characterized in that said surface lacquer consists predominantly of polyacrylates.

14. A roofing web according to claim 1, characterized in that the coating on the top side is embossed.

15. A roofing web according to claim 1, characterized in that said web has a width of from 205 to 320 cm.

16. In a structure having a roof covered with a coated fabric web, the improvement wherein such web comprises a web according to claim 1.

* * * * *